US011712866B2

(12) United States Patent
Kishimoto et al.

(10) Patent No.: US 11,712,866 B2
(45) Date of Patent: Aug. 1, 2023

(54) SHEET POST-PROCESSING APPARATUS

(71) Applicant: KYOCERA Document Solutions Inc., Osaka (JP)

(72) Inventors: Tadahisa Kishimoto, Osaka (JP); Koji Murata, Osaka (JP); Yoshiaki Tashiro, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/587,520

(22) Filed: Jan. 28, 2022

(65) Prior Publication Data

US 2022/0242084 A1 Aug. 4, 2022

(30) Foreign Application Priority Data

Feb. 4, 2021 (JP) ..... 2021-016540

(51) Int. Cl.

| | |
|---|---|
| ***B31F 1/10*** | (2006.01) |
| ***B42C 19/02*** | (2006.01) |
| ***B65H 45/04*** | (2006.01) |
| ***B65H 45/20*** | (2006.01) |

(52) U.S. Cl.

CPC ..... *B31F 1/10* (2013.01); *B42C 19/02* (2013.01); *B65H 45/04* (2013.01); *B65H 45/20* (2013.01); *B65H 2801/48* (2013.01)

(58) Field of Classification Search

CPC .... B31F 1/10; B31F 1/14; B31F 1/247; B42C 19/02; B65H 45/04; B65H 45/20; B65H 2801/48

USPC ..... 493/403, 419, 420, 421, 424, 427

See application file for complete search history.

(56) References Cited

U.S. PATENT DOCUMENTS

| | | | | |
|---|---|---|---|---|
| 5,076,556 | A * | 12/1991 | Mandel | B65H 45/148 270/47 |
| 5,993,369 | A * | 11/1999 | Sekita | G03G 15/6582 493/417 |
| 6,592,506 | B1 * | 7/2003 | Lyga | B65H 29/58 493/434 |
| 6,719,680 | B2 * | 4/2004 | Hosoya | B65H 45/142 493/434 |

(Continued)

FOREIGN PATENT DOCUMENTS

JP 2014-101164 A 6/2014

*Primary Examiner* — Sameh Tawfik

(74) *Attorney, Agent, or Firm* — Stein IP, LLC

(57) ABSTRACT

A sheet post-processing apparatus includes a first sheet conveyance passage, a second sheet conveyance passage, a sheet folding portion, and a merging portion. The second sheet conveyance passage branches off from a branch portion on the first sheet conveyance passage. The merging portion is located downstream of the branch portion on the first sheet conveyance passage, and there a folding conveyance passage of the sheet folding portion merges with the first sheet conveyance passage. When performing a folding process on a sheet, a controller guides the sheet conveyed from a sheet introduction port into the first sheet conveyance passage via the branch portion to the second sheet conveyance passage, then reverses the conveyance direction to guide the sheet to the sheet folding portion to perform the folding process, and passes the sheet through the folding conveyance passage, merges the sheet into the first sheet conveyance passage at the merging portion.

5 Claims, 5 Drawing Sheets

(56) References Cited

U.S. PATENT DOCUMENTS

| | | | | |
|---|---|---|---|---|
| 2014/0100100 | A1* | 4/2014 | Izumichi | B65H 45/18 493/416 |
| 2014/0141956 | A1 | 5/2014 | Suzuki et al. | 493/454 |
| 2014/0179504 | A1* | 6/2014 | Nakada | B65H 45/12 493/405 |
| 2014/0336031 | A1* | 11/2014 | Suzuki | B65H 45/14 493/442 |
| 2015/0307305 | A1* | 10/2015 | Saito | B65H 43/00 271/3.19 |
| 2021/0221639 | A1* | 7/2021 | Katayama | B42B 4/00 |

* cited by examiner

SHEET POST-PROCESSING APPARATUS

INCORPORATION BY REFERENCE

This application is based on and claims the benefit of priority from Japanese Patent Application No. 2021-016540 filed on Feb. 4, 2021, the contents of which are hereby incorporated by reference.

BACKGROUND

The present disclosure relates to a sheet post-processing apparatus that performs a folding process on, to make a fold in, a sheet having an image formed on it by an image forming apparatus.

Known sheet post-processing apparatuses include those which perform a folding process on, to make a fold in, a sheet that has an image formed on it by an image forming apparatus such as a copier or printer.

For example, a known sheet post-processing apparatus includes a first conveyance passage, a second conveyance passage, a communication passage that connect together the first and second conveyance passages, a second conveyance roller and a third conveyance roller that are arranged opposite each other in the communication passage, and the second and a fourth conveyance roller that are disposed opposite each other across the second conveyance passage. The second and third conveyance rollers constitute a first folding portion, and the second and fourth conveyance rollers constitute a second folding portion. This sheet post-processing apparatus can perform a folding process on a sheet with a short conveyance passage length and contributes to reducing the size of the apparatus.

SUMMARY

According to one aspect of the present disclosure, a sheet post-processing apparatus includes: a sheet introduction port, a first sheet conveyance passage, a second sheet conveyance passage, a switch guide, a sheet folding portion, a folding conveyance passage, a merging portion, and a controller. Through the sheet introduction port, a sheet is introduced. The first sheet conveyance passage extends from the sheet introduction port, and along the first sheet conveyance passage, the sheet is conveyed. The second sheet conveyance passage extends so as to branch off from a branch portion on the first sheet conveyance passage. The switch guide pivots, in the branch portion, between a first position in which the switch guide guides the sheet conveyed from the sheet introduction port along the first sheet conveyance passage toward the downstream end of the first sheet conveyance passage in the sheet conveyance direction and a second position in which the switch guide guides the sheet conveyed from the sheet introduction port along the first sheet conveyance passage to the second sheet conveyance passage. The sheet folding portion is located upstream, in the sheet conveyance direction, of the branch portion on the first sheet conveyance passage, and performs a folding process on the sheet. Through the folding conveyance passage, the sheet is conveyed in the sheet folding portion. The merging portion is located downstream, in the sheet conveyance direction, of the branch portion on the first sheet conveyance passage, and at the merging portion, the folding conveyance passage merges with the first sheet conveyance passage. The controller controls the first sheet conveyance passage, the second sheet conveyance passage, the switch guide, and the sheet folding portion. When performing the folding process on the sheet in the sheet folding portion, the controller first guides the downstream end, in the sheet conveyance direction, of the sheet conveyed from the sheet introduction port into the first sheet conveyance passage via the branch portion to the second sheet conveyance passage, then reverses the conveyance direction of the sheet to guide the sheet to the sheet folding portion to perform the folding process on the sheet, and then passes the sheet subjected to the folding process through the folding conveyance passage, and merges the sheet into the first sheet conveyance passage at the merging portion.

DETAILED DESCRIPTION

An embodiment of the present disclosure will be described below with reference to the accompanying drawings. What is specifically disclosed herein is not meant to limit the scope of the present disclosure.

Figure 1:
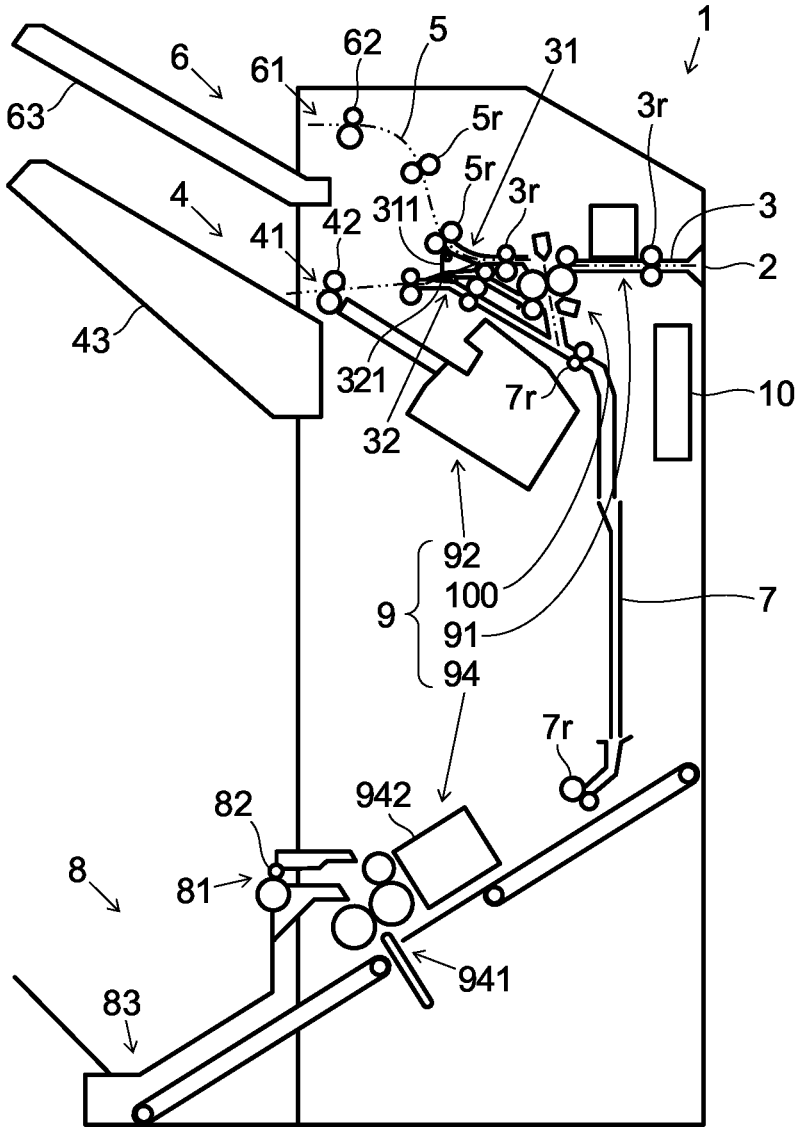
FIG. 1 is an outline sectional front view of a sheet post-processing apparatus according to an embodiment of the present disclosure, showing its construction.

FIG. 1 is an outline sectional front view of a sheet post-processing apparatus 1 according to the embodiment, showing its constructions. For example, the sheet post-processing apparatus 1 is coupled to a side face of an image forming apparatus (not shown) so as to be attachable to and detachable from it. The sheet post-processing apparatus 1 performs post-processing on a sheet that has undergone image formation (printing) by the image forming apparatus.

As shown in FIG. 1, the sheet post-processing apparatus 1 includes a sheet introduction port 2, a first sheet conveyance passage 3, a first sheet discharge portion 4, a second sheet conveyance passage 5, a second sheet discharge portion 6, a third sheet conveyance passage 7, a third sheet discharge portion 8, a post-processing portion 9, and a post-processing controller (controller) 10.

The sheet introduction port 2 is provided so as to be open in the side face of the sheet post-processing apparatus 1 facing the image forming apparatus (not shown). A sheet conveyed from the image forming apparatus to the sheet post-processing apparatus 1 is conveyed from the sheet introduction port 2 into the sheet post-processing apparatus 1.

The first sheet conveyance passage 3 extends from the sheet introduction port 2 to the first sheet discharge portion 4 substantially horizontally in a direction away from the image forming apparatus (i.e., leftward in FIG. 1). In the present description, the direction pointing from the sheet introduction port 2 to the first sheet discharge portion 4 is referred to as the sheet conveyance direction along the first sheet conveyance passage 3. The sheet introduction port 2 is located at the upstream end of the first sheet conveyance passage 3 in the sheet conveyance direction. The first sheet conveyance passage 3 has a plurality of pairs of conveyance rollers 3*r*, and conveys the sheet introduced into the sheet post-processing apparatus 1 downstream in the sheet conveyance direction.

The first sheet discharge portion 4 is provided in the side face of the sheet post-processing apparatus 1 opposite from its side face facing the image forming apparatus. The first sheet discharge portion 4 is disposed at the downstream end of the first sheet conveyance passage 3 in the sheet conveyance direction. The first sheet discharge portion 4 includes a first discharge port 41, a pair of first discharge rollers 42, and a first discharge tray 43.

The first discharge port 41 is located at the downstream end of the first sheet conveyance passage 3 in the sheet conveyance direction. The pair of first discharge rollers 42 is disposed in the first discharge port 41. The first discharge tray 43 is located downstream of the first discharge port 41 in the sheet conveyance direction. The sheet conveyed along the first sheet conveyance passage 3 to reach the first discharge port 41 is discharged through the first discharge port 41 onto the first discharge tray 43 by the pair of first discharge rollers 42. The first discharge tray 43 is one of the places where the sheet post-processed by the sheet post-processing apparatus 1 is eventually discharged.

The second sheet conveyance passage 5 branches off from a first branch portion (branch portion) 31 on the first sheet conveyance passage 3, and extends to the second sheet discharge portion 6 laterally, with an upward inclination, in a direction away from the image forming apparatus (i.e., leftward in FIG. 1). The first branch portion 31 is disposed downstream of a punching portion 91 in the sheet conveyance direction along the first sheet conveyance passage 3. In the present description, the direction pointing from the first branch portion 31 to the second sheet discharge portion 6 is referred to as the sheet conveyance direction along the second sheet conveyance passage 5. The first branch portion 31 is located at the upstream end of the second sheet conveyance passage 5 in the sheet conveyance direction. The second sheet conveyance passage 5 has a plurality of pairs of conveyance rollers 5*r*, and conveys the sheet having left the first sheet conveyance passage 3 at the first branch portion 31 downstream in the sheet conveyance direction.

The first branch portion 31 includes a first switch guide 311. The first switch guide 311 can pivot between a first position (broken line P1 in FIG. 6) in which the first switch guide 311 guides the sheet conveyed from the sheet introduction port 2 along the first sheet conveyance passage 3 toward the downstream end of the first sheet conveyance passage 3 in the sheet conveyance direction (i.e., toward the first discharge port 41) and a second position (solid line P2 in FIG. 6) in which the first switch guide 311 guides the sheet conveyed from the sheet introduction port 2 along the first sheet conveyance passage 3 toward the second sheet conveyance passage 5. The first switch guide 311 can pivot also to a third position (broken line P3 in FIG. 6) in which the first switch guide 311 guides a sheet subjected to a folding process and having passed through a second folding conveyance passage 106 (described later) toward the second sheet conveyance passage 5. The first switch guide 311 is connected to a drive mechanism (not shown), and its operation is controlled by the post-processing controller 10.

The second sheet discharge portion 6 is provided in the side face of the sheet post-processing apparatus 1 opposite from its side face facing the image forming apparatus, over the first sheet discharge portion 4. The second sheet discharge portion 6 is disposed at the downstream end of the second sheet conveyance passage 5 in the sheet conveyance direction. The second sheet discharge portion 6 includes a second discharge port 61, a second pair of discharge rollers 62, and a second discharge tray 63.

The second discharge port 61 is located at the downstream end of the second sheet conveyance passage 5 in the sheet conveyance direction. The second pair of discharge rollers 62 is disposed in the second discharge port 61. The second discharge tray 63 is located downstream of the second discharge port 61 in the sheet conveyance direction. The sheet conveyed along the second sheet conveyance passage 5 to reach the second discharge port 61 is discharged through the second discharge port 61 onto the second discharge tray 63 by the second pair of discharge rollers 62. The second discharge tray 63 is one of the places where the sheet post-processed by the sheet post-processing apparatus 1 is eventually discharged. Also discharged onto the second discharge tray 63 are sheets that are not subjected to post-processing and sheets of small sizes.

The third sheet conveyance passage 7 branches off from a second branch portion 32 on the first sheet conveyance passage 3, and extends downward to the third sheet discharge portion 8. In the present description, the direction pointing from the second branch portion 32 to the third sheet discharge portion 8 is referred to as the sheet conveyance direction along the third sheet conveyance passage 7. The second branch portion 32 is located downstream, in the sheet conveyance direction, of the first branch portion 31 on the first sheet conveyance passage 3, and is located at the upstream end of the third sheet conveyance passage 7 in the sheet conveyance direction. The third sheet conveyance passage 7 has a plurality of pairs of conveyance rollers 7*r*, and conveys the sheet having left the first sheet conveyance passage 3 at the second branch portion 32 downstream in the sheet conveyance direction.

The second branch portion 32 includes a second switch guide 321. The second switch guide 321 pivots between a first position in which the second switch guide 321 guides the sheet conveyed from the sheet introduction port 2 along the first sheet conveyance passage 3 toward the first discharge port 41 and a second position in which the second switch guide 321 guides the sheet conveyed from the sheet introduction port 2 along the first sheet conveyance passage 3 and then forwarded to the second branch portion 32 to be switched back toward the third sheet conveyance passage 7. The second switch guide 321 is connected to a drive mechanism (not shown), and its operation is controlled by the post-processing controller 10.

The third sheet discharge portion 8 is provided in the side face of the sheet post-processing apparatus 1 opposite from its side face facing the image forming apparatus, under the first sheet discharge portion 4. In other words, the third sheet discharge portion 8 is disposed near a bottom part of the sheet post-processing apparatus 1. The third sheet discharge portion 8 includes a third discharge port 81, a pair of third discharge rollers 82, and a third discharge tray 83.

The third discharge port 81 is located at the downstream end of the third sheet conveyance passage 7 in the sheet conveyance direction. The pair of third discharge rollers 82 is disposed in the third discharge port 81. The third discharge tray 83 is located downstream of the third discharge port 81 in the sheet conveyance direction. The sheet conveyed along the third sheet conveyance passage 7 to reach the third discharge port 81 is discharged via the third discharge port 81 onto the third discharge tray 83 by the pair of third discharge rollers 82. The third discharge tray 83 is one of the places where the sheet post-processed by the sheet post-processing apparatus 1 is eventually discharged.

The post-processing portion 9 performs predetermined post-processing on the sheet having undergone image formation by the image forming apparatus and introduced into the sheet post-processing apparatus 1. The post-processing portion 9 includes a punching portion 91, a stapling portion 92, a sheet folding portion 100, and a book-binding portion 94.

The punching portion 91 is disposed in the first sheet conveyance passage 3, closely downstream of the sheet introduction port 2. The punching portion 91 can performs a punching process on the sheet conveyed along the first sheet conveyance passage 3, thereby to form punch holes in it.

The stapling portion 92 is disposed in a downstream part of the first sheet conveyance passage 3 in the sheet conveyance direction, near the first sheet discharge portion 4. The stapling portion 92 can perform a stapling process (binding process) on a bundle of sheets formed by stacking together a plurality of sheets, thereby to bind the bundle of sheets.

The sheet folding portion 100 is disposed in the first sheet conveyance passage 3, downstream of the punching portion 91, upstream of the stapling portion 92. In other words, the sheet folding portion 100 is located upstream, in the sheet conveyance direction, of the first branch portion 31 on the first sheet conveyance passage 3. The sheet folding portion 100 can perform a folding process on a single sheet, thereby to make a fold in it.

Figure 2:
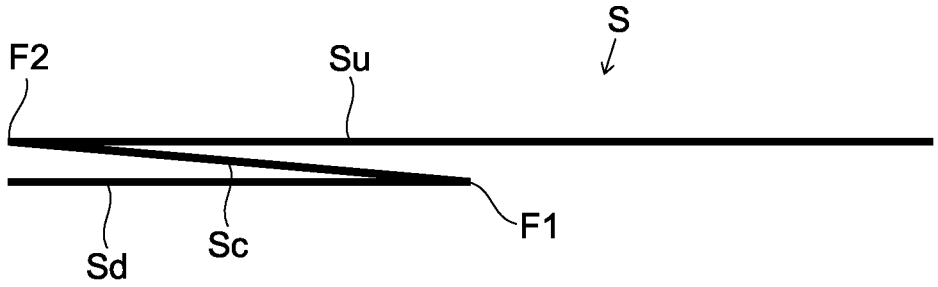
FIG. 2 is an outline front view of a Z-folded sheet.
Figure 3:
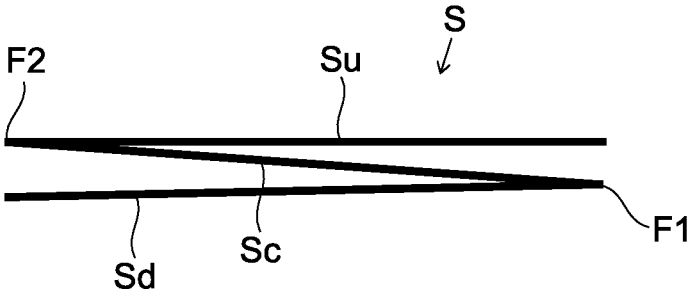
FIG. 3 is an outline front view of an outward triple-folded sheet.
Figure 4:
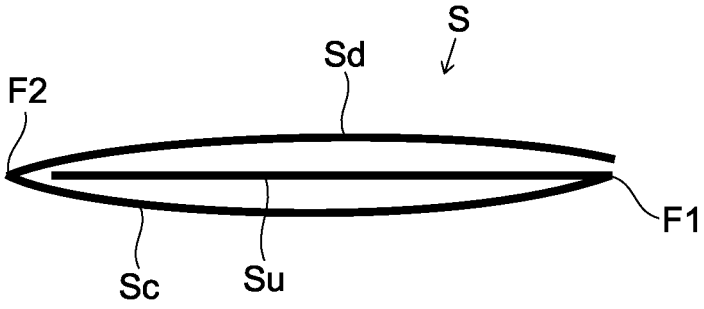
FIG. 4 is an outline front view of an inward triple-folded sheet.

The sheet folding portion 100 can perform folding processes such as double-folding, Z folding, outward triple folding, inward triple folding, and quadruple-folding. FIGS. 2, 3, and 4 are outline front views of a Z-folded sheet, an outward triple-folded sheet, and an inward triple-folded sheet respectively.

Z folding is a manner of folding in which, for example as shown in FIG. 2, a downstream part of a sheet S in the sheet conveyance direction along the first sheet conveyance passage 3 is formed into a Z-shape as seen from the sheet width direction orthogonal to the sheet conveyance direction. In Z folding, a downstream part Sd of the sheet S downstream of a first fold F1 in the first sheet conveyance passage 3 and an upstream part Su of the sheet S upstream of a second fold F2 face each other in the up-down direction across a middle part Sc of the sheet S between the two folds. With respect to the sheet conveyance direction, the downstream part Sd and the middle part Sc of the sheet S have approximately equal lengths, while being shorter than the upstream part Su.

Outward triple folding is a manner folding in which, for example as shown in FIG. 3, an entire sheet S is formed into a Z-shape as seen from the sheet width direction. In outward triple folding, a downstream part Sd of the sheet S downstream of a first fold F1 in the first sheet conveyance passage 3 and an upstream part Su of the sheet S upstream of a second fold F2 face each other in the up-down direction across a middle part Sc of the sheet S between the two folds. With respect to the sheet conveyance direction, the downstream part Sd, the middle part Sc, and the upstream part Su of the sheet S have approximately equal lengths.

In inward triple folding, for example as shown in FIG. 4, an upstream part Su of the sheet S upstream of a first fold F1 in the first sheet conveyance passage 3 and a downstream part Sd of the sheet S downstream of a second fold F2 face each other in the up-down direction and make surface contact with each other at one side of (in FIG. 4, above) the plane of a middle part Sc of the sheet S between the two folds.

The construction of the sheet folding portion 100 will be described in detail later.

The book-binding portion 94 is disposed in a downstream part of the third sheet conveyance passage 7 in the sheet conveyance direction, near the third sheet discharge portion 8. The book-binding portion 94 includes a middle-folding portion 941 and a middle-binding portion 942. The book-binding portion 94 performs, on a bundle of sheets formed by stacking together a plurality of sheets, a middle-folding process and a middle-binding process in which it folds and staples the bundle of sheets substantially at its middle, thereby to form a booklet.

The post-processing controller 10 includes a CPU, an image processor, and a storage as well as other electronic circuits and electronic components (of which none are shown). The post-processing controller 10 is connected to, so as to be able to communicate with, a main controller in the image forming apparatus (not shown). In response to instructions from the main controller, by the operation of the CPU, and based on control programs and control data stored in the storage, the post-processing controller 10 controls the operation of the individual blocks provided in the sheet post-processing apparatus 1 to perform processes related to the functions of the sheet post-processing apparatus 1. The first sheet conveyance passage 3, the first sheet discharge portion 4, the second sheet conveyance passage 5, the second sheet discharge portion 6, the third sheet conveyance passage 7, the third sheet discharge portion 8, and the post-processing portion 9 individually receive instructions from the post-processing controller 10 to cooperate so as to perform post-processing on sheets. The functions of the post-processing controller (controller) 10 may be assumed by the main controller in the image forming apparatus.

Figure 5:
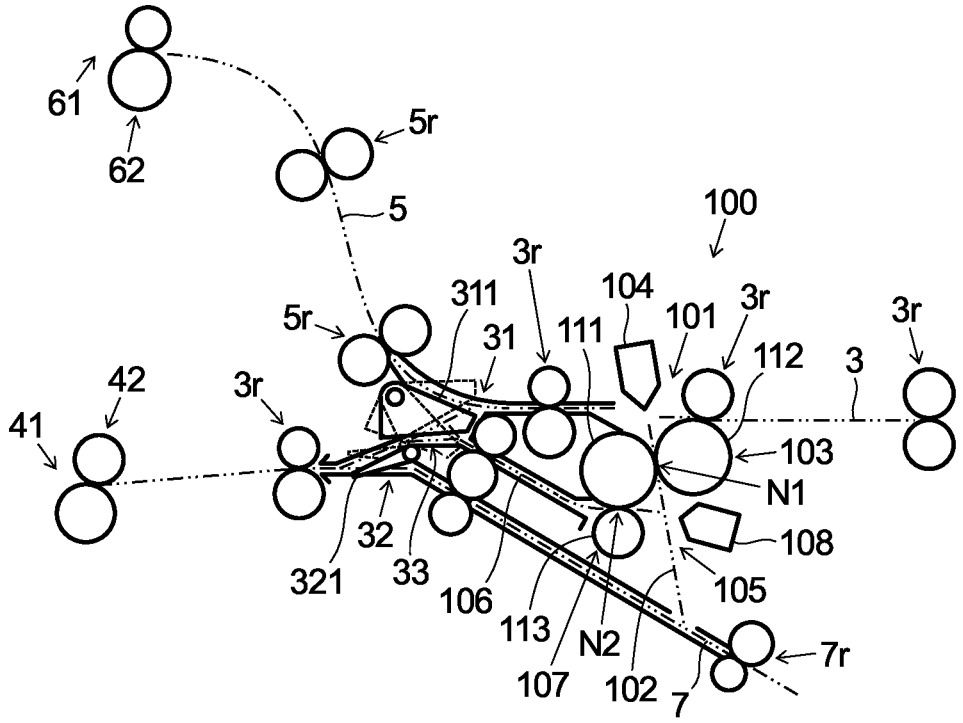
FIG. 5 is a part sectional front view around a sheet folding portion in the sheet post-processing apparatus in FIG. 1.

Next, the construction of the sheet folding portion 100 will be described with reference to FIG. 5. FIG. 5 is a part sectional front view around the sheet folding portion 100 in the sheet post-processing apparatus 1 in FIG. 1. The sheet folding portion 100 includes a first folding portion 101, a first folding conveyance passage 102, a pair of first folding rollers 103, a first folding guide 104, a second folding portion 105, a second folding conveyance passage 106, a pair of second folding rollers 107, and a second folding guide 108.

The first folding portion 101 is disposed on the first sheet conveyance passage 3. Specifically, the first folding portion 101 is located downstream, in the sheet conveyance direction, of where the punching portion 91 (see FIG. 1) is disposed on the first sheet conveyance passage 3, upstream of the first branch portion 31 in the sheet conveyance direction.

The first folding conveyance passage 102 extends so as to branch off from the first folding portion 101 on the first sheet conveyance passage 3. The first folding conveyance passage 102 extends downward from the first folding portion 101. In the embodiment, the first folding conveyance passage 102 extends substantially vertically downward from the first folding portion 101. The first folding conveyance passage 102 at its lowest end connects to the third sheet conveyance passage 7.

The pair of first folding rollers 103 is disposed on the first folding conveyance passage 102 in the first folding portion 101. The pair of first folding rollers 103 is composed of a first roller 111 and a second roller 112. With one of the first and second rollers 111 and 112 urged to make contact with the other, the pair of first folding rollers 103 forms a first folding nip N1. The sheet having entered the first folding conveyance passage 102 passes through the first folding nip N1 and is conveyed to under the pair of first folding rollers 103.

The second roller 112 doubles as one of the rollers that constitute one of the pairs of conveyance rollers 3*r* on the first sheet conveyance passage 3.

The first folding guide 104 is disposed in the first folding portion 101, opposite the first folding nip N1. Specifically, the first folding guide 104 is disposed upstream of the first folding nip N1 in the sheet conveyance direction along the first folding conveyance passage 102, that is, over the first folding nip N1 in FIG. 5. When no folding process is performed on the sheet, the first folding guide 104 is retracted from the first sheet conveyance passage 3 in a direction away from the first folding nip N1, that is, to over the first sheet conveyance passage 3 in FIG. 5. Thus the sheet passing through the first sheet conveyance passage 3 does not make contact with the first folding guide 104.

The first folding guide 104 is connected to a drive mechanism (not shown), and is reciprocatable in directions toward and away from the first folding nip N1. The first folding guide 104 guides the sheet conveyed along the first sheet conveyance passage 3 to the first folding nip N1.

The second folding portion 105 is disposed on the first folding conveyance passage 102. Specifically, the second folding portion 105 is located on the first folding conveyance passage 102, downstream, in the sheet conveyance direction, of where the pair of first folding rollers 103 is disposed, under the first folding nip N1.

The second folding conveyance passage 106 extends so as to branch off from the second folding portion 105 on the first folding conveyance passage 102. The second folding conveyance passage 106 extends from the second folding portion 105 toward the side face of the sheet post-processing apparatus 1 where the first sheet discharge portion 4 is provided, that is, leftward in FIG. 5. In other words, the second folding conveyance passage 106 extends substantially in the same direction as the first sheet conveyance passage 3 does.

The first sheet conveyance passage 3 has a merging portion 33 located downstream of the first branch portion 31 in the sheet conveyance direction. The second folding conveyance passage 106 merges with the first sheet conveyance passage 3 at the merging portion 33. In other words, the merging portion 33 is located downstream, in the sheet conveyance direction, of the first branch portion 31 on the first sheet conveyance passage 3, and at the merging portion 33, the sheet subjected to a folding process in the sheet folding portion 100 is fed back into the first sheet conveyance passage 3.

Specifically, in the embodiment, the merging portion 33 is located in the vicinity of the first switch guide 311. The first switch guide 311, when located in the second position in which it guides the sheet conveyed from the sheet introduction port 2 along the first sheet conveyance passage 3 to the second sheet conveyance passage 5, guides the sheet subjected to a folding process and merged into the first sheet conveyance passage 3 at the merging portion 33 to the downstream end side of the first sheet conveyance passage 3 in the sheet conveyance direction. The first switch guide 311, when located in the second position, closes at the merging portion 33 the part of the first sheet conveyance passage 3 upstream of it in the sheet conveyance direction.

The pair of second folding rollers 107 is disposed in the second folding portion 105, on the second folding conveyance passage 106. The pair of second folding rollers 107 is composed of the first roller 111 and a third roller 113. With one of the first and third rollers 111 and 113 urged to make contact with the other, the pair of second folding rollers 107 forms a second folding nip N2. The sheet having entered the second folding conveyance passage 106 passes through the second folding nip N2 and is conveyed toward the merging portion 33, that is, toward the left side of the pair of second folding rollers 107 in FIG. 5.

The second folding guide 108 is disposed in the second folding portion 105, opposite the second folding nip N2. Specifically, the second folding guide 108 is disposed upstream of the second folding nip N2 in the sheet conveyance direction along the second folding conveyance passage 106, that is, to the right of the second folding nip N2 in FIG. 5. When no folding process is performed on the sheet, the second folding guide 108 is retracted from the first folding conveyance passage 102 in a direction away from the second folding nip N2, that is, to the right of the first folding conveyance passage 102 in FIG. 5. Thus the sheet passing through the first folding conveyance passage 102 does not make contact with the second folding guide 108.

The second folding guide 108 is connected to a drive mechanism (not shown), and is reciprocatable in directions toward and away from the second folding nip N2. The second folding guide 108 guides the sheet conveyed along the first folding conveyance passage 102 to the second folding nip N2.

Next, the operation of the sheet folding portion 100 will be described with reference to FIGS. 6, 7, 8, and 9. FIGS. 6, 7, 8, and 9 are sectional front views around the sheet folding portion 100 in FIG. 5, respectively showing a first, a second, a third, and a fourth stage during the course of an inward triple folding process on a sheet S. The following description of the operation of the sheet folding portion 100 deals with, as an example, a folding process for inward triple folding as shown in FIG. 4.

Figure 6:
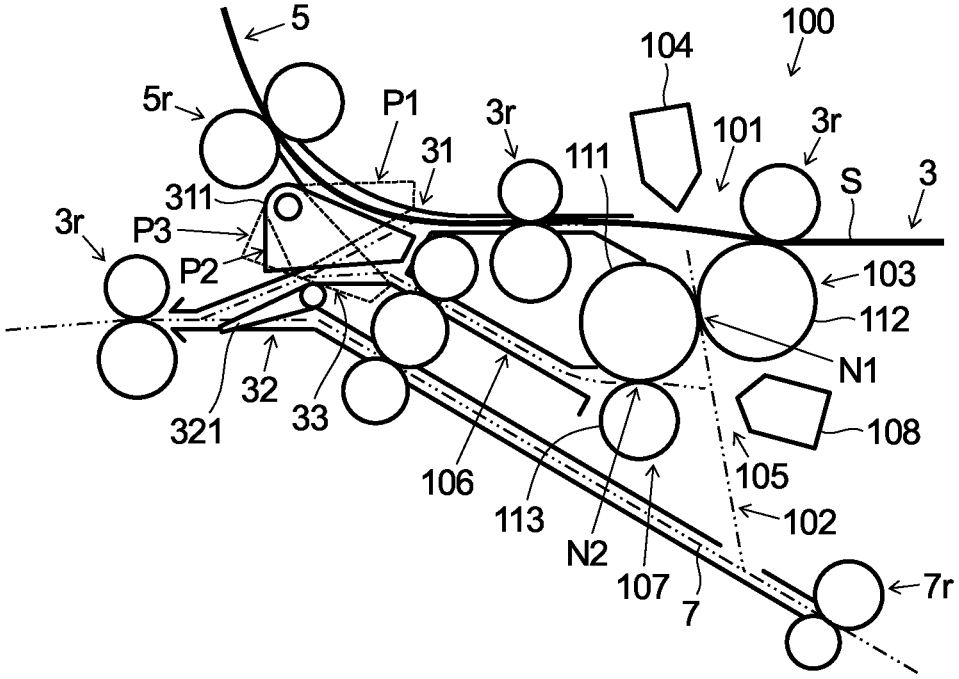
FIG. 6 is a sectional front view around the sheet folding portion in FIG. 5, showing a first stage during the course of an inward triple-folding process for a sheet.

As shown in FIG. 6, when a sheet S is conveyed from the sheet introduction port 2 (see FIG. 1) into the first sheet conveyance passage 3, a downstream part of the sheet S in the sheet conveyance direction is guided via the first branch portion 31 to the second sheet conveyance passage 5. The first switch guide 311 in the first branch portion 31 is located in the second position in which it guides the sheet S conveyed from the sheet introduction port 2 along the first sheet conveyance passage 3 to the second sheet conveyance passage 5.

In the first folding portion 101, the first folding guide 104 is retracted from the first sheet conveyance passage 3 in a direction away from the first folding nip N1, that is, to over the first sheet conveyance passage 3 in FIG. 6.

Subsequently, when the part of the sheet S corresponding to the first fold F1 (see FIG. 4) reaches the first folding portion 101, the pairs of conveyance rollers 3*r* in the first sheet conveyance passage 3 and the pairs of conveyance rollers 5*r* in the second sheet conveyance passage 5 are stopped from rotating, and the sheet S ceases to be conveyed. Then those of the pairs of conveyance rollers 3*r* in the first sheet conveyance passage 3 which are disposed downstream of the first folding portion 101 in the sheet conveyance direction (to the left of the first folding portion 101 in FIG. 6) and the pairs of conveyance rollers 5*r* in the second sheet conveyance passage 5 are rotated reversely. As a result, the part of the sheet S downstream of the first folding portion 101 in the sheet conveyance direction moves upstream (rightward in FIG. 6) so that the sheet S sags at the first folding portion 101.

Subsequently the first folding guide 104 is moved in a direction toward the first folding nip N1 and makes contact with the sheet S. The contact with the first folding guide 104 guides the sagging part of the sheet S to the first folding nip N1 in the pair of first folding rollers 103. As the sheet S passes through the first folding nip N1, the first fold F1 is formed in it as shown in FIG. 7.

The timing with which the first fold F1 is formed in the sheet is determined in accordance with the timing with which a sheet sensor (not shown) detects, in the first sheet conveyance passage 3, the downstream end of the sheet S in the sheet conveyance direction, the length of the sheet S in the sheet conveyance direction, and the conveyance speed of the sheet S. The same is true with the timing with which the second fold F2 is formed (described later).

Figure 7:
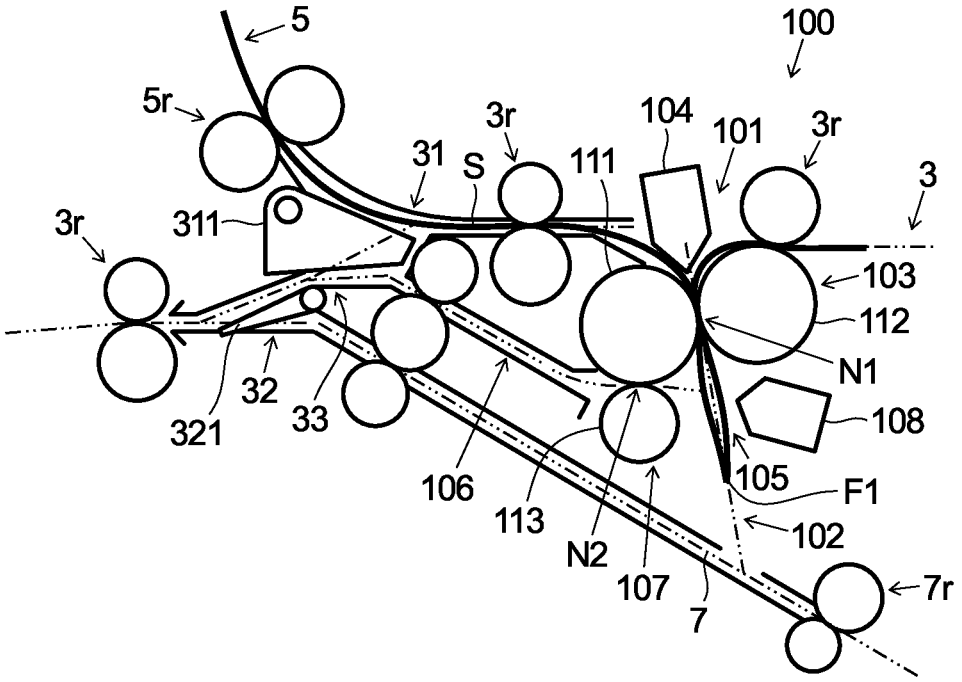
FIG. 7 is a sectional front view around the sheet folding portion in FIG. 5, showing a second stage during the course of the inward triple-folding process for a sheet.

In the second folding portion 105, the second folding guide 108 is retracted from the first folding conveyance passage 102 in a direction away from the second folding nip N2, that is, to the right of the first folding conveyance passage 102 in FIG. 7.

The sheet S having passed through the first folding nip N1 is conveyed, starting with its part where the first fold F1 is formed, and with its two regions that extend along the sheet conveyance direction overlapping with each other, along the first folding conveyance passage 102 in a direction away from the pair of first folding rollers 103. An upstream part of the sheet S having passed through the first folding conveyance passage 102 momentarily enters the third sheet conveyance passage 7.

Subsequently, when the part of the sheet S corresponding to the second fold F2 (see FIG. 4) reaches the second folding portion 105, the pairs of conveyance rollers 3*r* in the first sheet conveyance passage 3, the pairs of conveyance rollers 5*r* in the second sheet conveyance passage 5, and the pairs of conveyance rollers 7*r* in the third sheet conveyance passage 7 are stopped from rotating, and the sheet S ceases to be conveyed. Then the pairs of conveyance rollers 7*r* in the third sheet conveyance passage 7 are rotated reversely. As a result, the part of the sheet S downstream of the second folding portion 105 in the sheet conveyance direction (below the second folding portion 105 in FIG. 7) moves upstream (upward in FIG. 7) so that the sheet S sags at the second folding portion 105.

Figure 8:
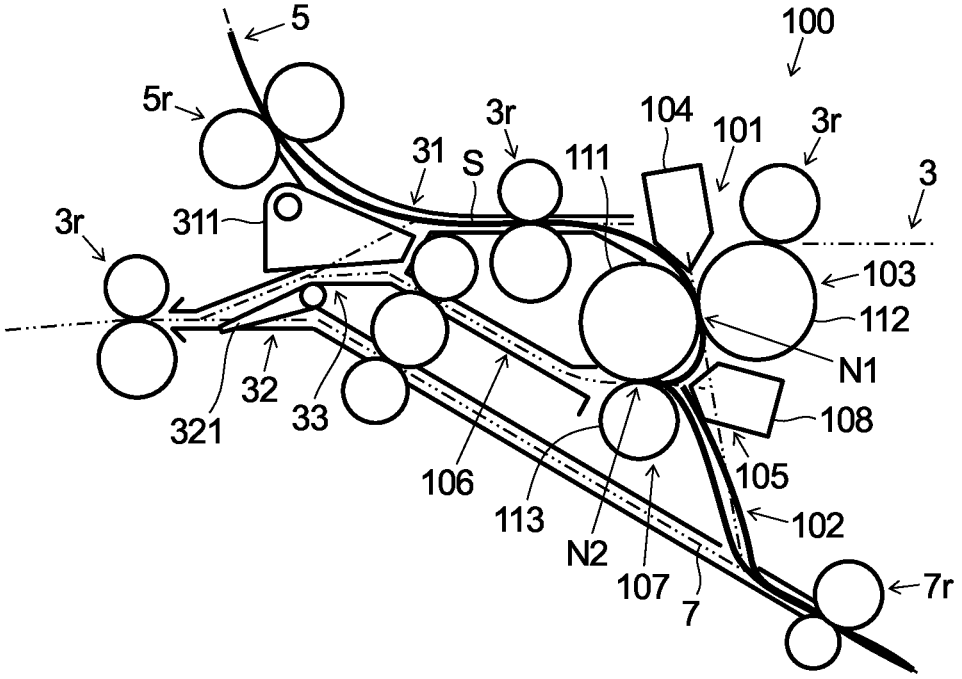
FIG. 8 is a sectional front view around the sheet folding portion in FIG. 5, showing a third stage during the course of the inward triple-folding process for a sheet.

Subsequently, the second folding guide 108 is moved in a direction toward to the second folding nip N2 and makes contact with the sheet S. As shown in FIG. 8, the contact with the second folding guide 108 guides the sagging part of the sheet S to the second folding nip N2. As the sheet S passes through the second folding nip N2, the second fold F2 is formed in it (see FIG. 9).

Figure 9:
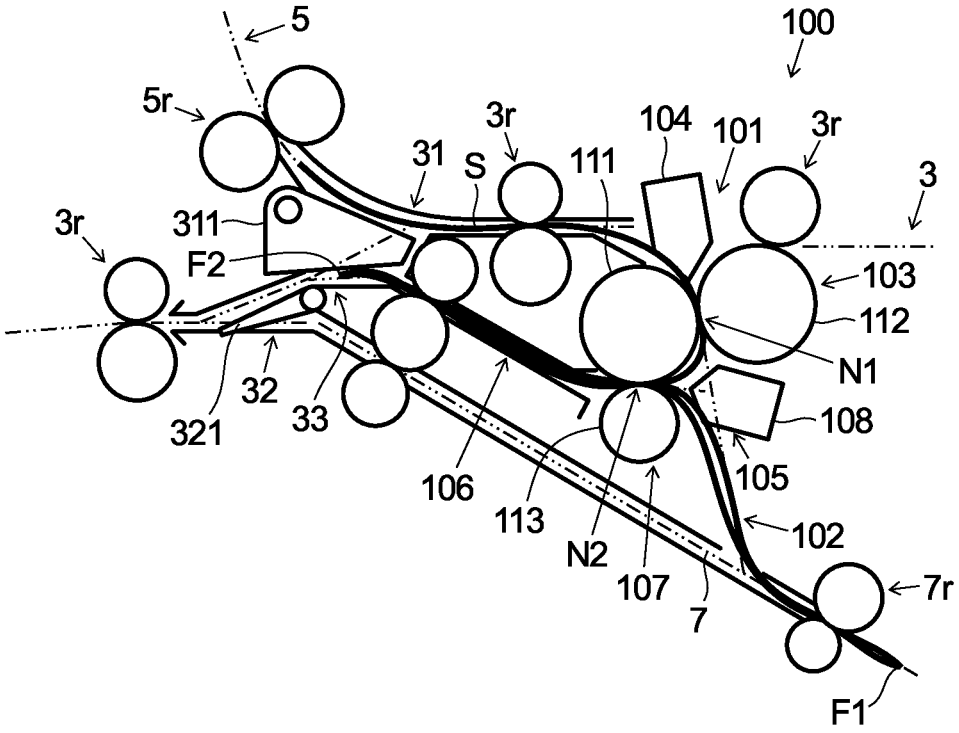
FIG. 9 is a sectional front view around the sheet folding portion in FIG. 5, showing a fourth stage during the course of the inward triple-folding process for a sheet.

As shown in FIG. 9, the sheet S having passed through the second folding nip N2 is conveyed, starting with its part where the second fold F2 is formed, and with its three regions that extend along the sheet conveyance direction overlapping with each other, along the second folding conveyance passage 106 in a direction away from the pair of second folding rollers 107. An upstream part of the sheet S having passed through the second folding conveyance passage 106 enters the first sheet conveyance passage 3 via the merging portion 33 and is guided toward the first sheet discharge portion 4. Meanwhile, at the merging portion 33, the first switch guide 311 in the second position in which it guides the sheet S conveyed from the sheet introduction port 2 along the first sheet conveyance passage 3 to the second sheet conveyance passage 5 guides the sheet S along the first sheet conveyance passage 3 toward the first sheet discharge portion 4.

As described above, when performing a folding process on a sheet S in the sheet folding portion 100, the post-processing controller 10 first guides the downstream end, in the sheet conveyance direction, of the sheet conveyed from the sheet introduction port 2 into the first sheet conveyance passage 3 via the first branch portion 31 to the second sheet conveyance passage 5, and then reverses the conveyance direction of the sheet to guide the sheet S to the sheet folding portion 100 to perform the folding process on the sheet S. Then, the post-processing controller 10 merges the sheet S subjected to the folding process into the first sheet conveyance passage 3 at the merging portion 33.

With this construction, as shown in FIG. 9, owing to the merging portion 33, the sheet S subjected to a folding process in the sheet folding portion 100 can readily be fed into the first sheet conveyance passage 3, and this contributes to reducing the size of the sheet post-processing apparatus 1. The second fold F2 in the sheet S enters the first sheet conveyance passage 3 via the merging portion 33, and at that time a downstream part, in the sheet conveyance direction, of the sheet S conveyed from the sheet introduction port 2 into the apparatus has entered the second sheet conveyance passage 5. Thus, when performing a folding process on the sheet S, the sheet post-processing apparatus 1 can prevent parts of the sheet S from making contact with each other.

As described above, the sheet folding portion 100 includes the first folding conveyance passage 102, the pair of first folding rollers 103, the first folding guide 104, the second folding conveyance passage 106, the pair of second folding rollers 107, and the second folding guide 108. With this construction, the sheet S passing from the second folding portion 105 on the first folding conveyance passage 102 into the second folding conveyance passage 106 can be passed via the merging portion 33 into the first sheet conveyance passage 3. This contributes to reducing the size of the sheet post-processing apparatus 1.

Moreover, the sheet folding portion 100 includes the first and second rollers 111 and 112 that constitute the pair of first folding rollers 103 and the third rollers 113 that constitute the pair of second folding rollers 107 together with the first roller 111. With this construction, the first roller 111 can be shared between the two pairs of folding rollers, namely the pair of first folding rollers 103 and the pair of second folding rollers 107. This contributes to reducing the size of the sheet folding portion 100, and hence contributes to reducing the size of the sheet post-processing apparatus 1.

Moreover, the sheet post-processing apparatus 1 includes the first sheet discharge portion 4 that is disposed at the downstream end of the first sheet conveyance passage 3 in the sheet conveyance direction and on which the sheet S is discharged and the second sheet discharge portion 6 that is disposed at the downstream end of the second sheet conveyance passage 5 in the sheet conveyance direction and on which the sheet S is discharged. With this construction, in a case where a folding process is performed on the sheet, it is possible to use the second sheet conveyance passage 5 when discharging the sheet S onto the second sheet discharge portion 6 in order to prevent contact between parts of the sheet S. That is, contact between parts of the sheet S is prevented not by additionally providing the second sheet conveyance passage 5; instead, an efficient use of an existing structure is made to prevent contact between parts of the sheet S.

The embodiment specifically described above is in no way meant to limit the scope of the present disclosure, which thus allows for various modifications without departure from the spirit of the present disclosure.

What is claimed is:

1. A sheet post-processing apparatus comprising:

a sheet introduction port through which a sheet is introduced;

a first sheet conveyance passage that extends from the sheet introduction port and along which the sheet is conveyed;

a second sheet conveyance passage that extends so as to branch off from a branch portion on the first sheet conveyance passage;

a switch guide that pivots in the branch portion between a first position in which the switch guide guides the sheet conveyed from the sheet introduction port along the first sheet conveyance passage toward a downstream end of the first sheet conveyance passage in a sheet conveyance direction and a second position in which the switch guide guides the sheet conveyed from the sheet introduction port along the first sheet conveyance passage to the second sheet conveyance passage;

a sheet folding portion that is located upstream, in the sheet conveyance direction, of the branch portion on the first sheet conveyance passage and that performs a folding process on the sheet;

a folding conveyance passage along which the sheet is conveyed in the sheet folding portion;

a merging portion that is located downstream, in the sheet conveyance direction, of the branch portion on the first sheet conveyance passage and at which the folding conveyance passage merges with the first sheet conveyance passage;

a controller that controls the first sheet conveyance passage, the second sheet conveyance passage, the switch guide, and the sheet folding portion, wherein when performing the folding process on the sheet in the sheet folding portion, the controller first guides a downstream end, in the sheet conveyance direction, of the sheet conveyed from the sheet introduction port into the first sheet conveyance passage via the branch portion to the second sheet conveyance passage, then reverses a conveyance direction of the sheet to guide the sheet to the sheet folding portion to perform the folding process on the sheet, and then passes the sheet subjected to the folding process through the folding conveyance passage, and merges the sheet into the first sheet conveyance passage at the merging portion, the folding conveyance passage includes:

a first folding conveyance passage that extends, wherein to branch off from a first folding portion on the first sheet conveyance passage; and a second folding conveyance passage that extends, wherein to branch off from a second folding portion on the first folding conveyance passage and that merges the first sheet conveyance passage at the merging portion, and the sheet folding portion includes:

a pair of first folding rollers that is disposed on the first folding conveyance passage in the first folding portion and that forms a first folding nip;

a pair of second folding rollers that is disposed on the second folding conveyance passage in the second folding portion and that forms a second folding nip;

a first folding guide that is disposed opposite the first folding nip in the first folding portion and that, by reciprocating in directions toward and away from the first folding nip, guides the sheet conveyed along the first sheet conveyance passage to the first folding nip; and a second folding guide that is disposed opposite the second folding nip in the second folding portion and that, by reciprocating in directions toward and away from the second folding nip, guides the sheet conveyed along the first folding conveyance passage to the second folding nip.

2. The sheet post-processing apparatus according to claim 1, wherein the merging portion is located in the vicinity of the switch guide, and the switch guide, when located in the second position, guides the sheet subjected to the folding process and merged into the first sheet conveyance passage at the merge portion to the downstream end side of the first sheet conveyance passage.

3. The sheet post-processing apparatus according to claim 1, wherein the sheet folding portion includes:

a first roller and a second roller that constitute the pair of first folding rollers; and a third roller that constitute the pair of second folding rollers together with the first roller.

4. The sheet post-processing apparatus according to claim 1, further comprising:

a first sheet discharge portion that is disposed at the downstream end of the first sheet conveyance passage in the sheet conveyance direction and configured to discharge the sheet; and a second sheet discharge portion that is disposed at a downstream end of the second sheet conveyance passage in the sheet conveyance direction and configured to discharge the sheet.

5. The sheet post-processing apparatus according to claim 1, further comprising:

a punching portion that is located on an upstream side in the sheet conveyance direction, of the sheet folding portion in the first sheet conveyance passage and that forms a punch hole in the sheet;

a stapling portion that is located on a downstream side in the sheet conveyance direction, of the merging portion on the first sheet conveyance passage and that staples a bundle of sheets formed of a plurality of sheets;

a third sheet conveyance passage that extends so as to branch off from the downstream side of the merging portion of a part of the first sheet conveyance passage in the sheet conveyance direction; and a book-binding portion that binds and folds a bundle of sheets including a plurality of the sheets that have passed through the third sheet conveyance passage and that thereby forms a booklet.

* * * * *